US007526068B2

(12) United States Patent
Dinsmore

(10) Patent No.: US 7,526,068 B2
(45) Date of Patent: Apr. 28, 2009

(54) X-RAY SOURCE FOR MATERIALS ANALYSIS SYSTEMS

(75) Inventor: Mark Dinsmore, Sudbury, MA (US)

(73) Assignee: Carl Zeiss AG, Oberkochen (DE)

( * ) Notice: Subject to any disclaimer, the term of this patent is extended or adjusted under 35 U.S.C. 154(b) by 0 days.

(21) Appl. No.: 10/481,392

(22) PCT Filed: Jun. 18, 2002

(86) PCT No.: PCT/US02/19235

§ 371 (c)(1),
(2), (4) Date: Mar. 23, 2006

(87) PCT Pub. No.: WO02/103743

PCT Pub. Date: Dec. 27, 2002

(65) Prior Publication Data

US 2006/0233307 A1 Oct. 19, 2006

(51) Int. Cl.
*H01J 35/30* (2006.01)

(52) U.S. Cl. ..... 378/137; 378/121

(58) Field of Classification Search ..... 378/121, 378/126, 136, 137, 138, 143
See application file for complete search history.

(56) References Cited

U.S. PATENT DOCUMENTS

| | | | | | |
|---|---|---|---|---|---|
| 4,185,365 | A | * | 1/1980 | Hueschen et al. | 445/28 |
| 4,322,653 | A | * | 3/1982 | Bader et al. | 378/140 |
| 4,878,866 | A | | 11/1989 | Mori et al. | |
| 5,090,043 | A | | 2/1992 | Parker et al. | 378/121 |
| 5,153,900 | A | | 10/1992 | Nomikos et al. | 378/65 |
| RE34,421 | E | | 10/1993 | Parker et al. | 378/121 |
| 5,369,679 | A | | 11/1994 | Sliski et al. | 378/65 |
| 5,422,926 | A | | 6/1995 | Smith et al. | 378/121 |
| 5,428,658 | A | | 6/1995 | Oettinger et al. | 378/119 |
| 5,504,799 | A | | 4/1996 | Suzuki | |
| 5,534,824 | A | | 7/1996 | Nalos et al. | 331/81 |
| 5,563,555 | A | | 10/1996 | Nalos et al. | 331/81 |
| 5,621,780 | A | | 4/1997 | Smith et al. | 378/65 |
| 5,621,781 | A | | 4/1997 | Blake et al. | |
| 6,130,931 | A | | 10/2000 | Laurila et al. | 378/45 |
| 6,195,411 | B1 | | 2/2001 | Dinsmore | 378/65 |
| 6,266,390 | B1 | | 7/2001 | Sommer, Jr. et al. | 378/45 |
| 6,319,188 | B1 | | 11/2001 | Lovoi | 600/3 |
| 6,320,932 | B2 | | 11/2001 | Dinsmore | 378/65 |

(Continued)

FOREIGN PATENT DOCUMENTS

| | | |
|---|---|---|
| JP | 3-285239 | 12/1991 |

(Continued)

*Primary Examiner*—Hoon Song
(74) *Attorney, Agent, or Firm*—Foley & Lardner LLP; John M. Garvey

(57) ABSTRACT

A miniaturized, increased efficiency x-ray source for materials analysis includes a laser source, an optical delivery structure, a laser-driven thermionic cathode (108), an anode (122), and a target from the laser source and directs the beam onto a surface of the themionic cathode. The surfaces electrons form an electron beam along a beam path. The target element (110) is disposed in the beam path, and emits x-rays in response to incident accelerated electrons from the thermionic cathode. The target element includes an inclined surface that forms an angle of inclination (113) of about 40 degrees with respect to the electon beam path, so that x-rays are emitted from the target substantially at an angle of about 45 degrees with respect to the electron beam path.

26 Claims, 3 Drawing Sheets

U.S. PATENT DOCUMENTS

| | | | | |
|---|---|---|---|---|
| 6,320,935 | B1 | 11/2001 | Shinar et al. | 378/119 |
| 6,324,257 | B1 | 11/2001 | Halavee | 378/121 |
| 6,345,086 | B1 | 2/2002 | Ferrandino et al. | 378/44 |
| 6,438,206 | B1 * | 8/2002 | Shinar et al. | 378/123 |
| 6,459,767 | B1 | 10/2002 | Boyer | 378/121 |
| 6,486,573 | B2 | 11/2002 | Yagi et al. | 307/328 |
| 6,496,565 | B2 | 12/2002 | Matoba et al. | 378/147 |
| 2001/0016027 | A1 | 8/2001 | Dinsmore | 378/65 |
| 2002/0154738 | A1 * | 10/2002 | Mori | 378/119 |
| 2002/0191746 | A1 * | 12/2002 | Dinsmore | 378/119 |

FOREIGN PATENT DOCUMENTS

| | | |
|---|---|---|
| WO | WO 93/04735 | 3/1993 |
| WO | WO 95/20241 | 7/1995 |
| WO | WO 01/47596 | 7/2001 |

* cited by examiner

X-RAY SOURCE FOR MATERIALS ANALYSIS SYSTEMS

FIELD OF THE INVENTION

The present invention relates to radiation sources, and more particularly to an increased efficiency, optically-driven, miniaturized x-ray source for materials analysis systems.

BACKGROUND OF THE INVENTION

X-rays are widely used in materials analysis systems. For example, x-ray spectrometry is an economical technique for quantitatively analyzing the elemental composition of samples. The irradiation of a sample by high energy electrons, protons, or photons ionizes some of atoms in the sample. These atoms emit characteristic x-rays, whose wavelengths depends on the atomic number of the atoms forming the sample, because x-ray photons typically come from the tightly bound inner-shell electrons in the atoms. The intensity of the emitted x-ray spectra is related to the concentration of the atoms within the sample.

Another example is x-ray fluoroscopy, which is used for chemical analyses of solids and liquids. Typically, a specimen is irradiated by an intense x-ray beam, which causes the elements in the specimen to fluoresce, i.e. to emit their characteristic x-ray line spectra. The lines of the spectra can be diffracted at various angles by a single-crystal plate. The elements may be identified by the wavelengths of their spectral lines, which vary in a known manner with atomic number. The concentrations of the elements in the specimen may be determined from the intensities of the lines. The x-ray fluorescence method has proven to the particularly useful for mixtures of elements of similar chemical properties, which are difficult to separate and analyze by conventional chemical methods.

Typically, the x-rays used for materials analysis are produced in an x-ray tube by accelerating electrons to a high velocity by an electrostatic field, and then suddenly stopping them by collision with a solid target interposed in their path. The x-rays radiate in all directions from a spot on the target where the collisions take place. The x-rays are emitted due to the mutual interaction of the accelerated electrons with the electrons and the positively charged nuclei which constitute the atoms of the target. High-vacuum x-ray tubes typically include a thermionic cathode, and a solid target. Conventionally, the thermionic cathode is resistively heated, for example by heating a filament resistively with a current. Upon reaching of a thermionic temperature, the cathode thermionically emits electrons into the vacuum. An accelerating electric field is established which acts to accelerate electrons generated from the cathode toward the target. A high voltage source, such as a high voltage power supply, may be used to establish the accelerating electric field. In some cases, the accelerating electric field may be established between the cathode and an intermediate gate electrode, such as an anode. In this configuration, a substantially field-free drift region is provided between the anode and the target. In some cases, the anode may also function as a target.

In one form of a conventional x-ray machine, the cathode assembly may consist of a thoriated tungsten coil approximately 2 mm in diameter and 1 to 2 cm in length. When resistively heated with a current of 4 A or higher, the thoriated tungsten coil thermionically emits electrons. In many applications, most of the energy from the electron beam is converted into heat at the anode. To accommodate such heating, high power x-ray sources often utilize liquid cooling and a rapidly rotating anode.

It is desirable that the cathode be heated as efficiently as possible, namely that the thermionic cathode reach as high a temperature as possible using as little power as possible. In conventional x-ray tubes, for example, thermal vaporization of the tube's coiled cathode filament is frequently responsible for tube failure. Also, the anode heated to a high temperature can cause degradation of the radiation output. During relatively long exposures from an x-ray source, e.g. during exposures lasting from about 1 to about 3 seconds, the anode temperature may rise sufficiently to cause it to glow brightly, accompanied by localized surface melting and pitting which degrades the radiation output.

In the field of medicine and radiotherapy, an optically driven (for example, laser driven) therapeutic radiation source has been disclosed in U.S. application Ser. No. 09/884,561, commonly owned by the assignee of the present invention, and hereby incorporated by reference (hereinafter the '561 application). This optically driven therapeutic radiation source uses a reduced-power, increased efficiency electron source, which generates electrons with minimal heat loss. The '561 application discloses the use of laser energy to heat an electron emissive surface of a thermionic emitter, instead of using an electric current to ohmically heat an electron emissive surface of a thermionic emitter. With the optically driven thermionic emitter, electrons can be produced in a quantity sufficient to produce the electron current necessary for generating therapeutic radiation at the target, while significantly reducing the requisite power requirements.

For materials analysis systems, however, there is a need for miniaturized, increased efficiency x-ray sources. It is an object of this invention to provide a miniaturized, portable x-ray source for materials analysis systems, including but not limited to x-ray spectroscopy and x-ray fluoroscopy. It is another object of this invention to provide an increased efficiency x-ray source having significantly reduced power requirements, for use in materials analysis systems.

It is another object of this invention to provide a miniaturized x-ray source for materials analysis systems, including an electron source that can generate electrons with minimal heat loss. It is yet another object of this invention to provide a miniaturized x-ray source for materials analysis, in which an optical source is used to heat a thermionic cathode, instead of using conventional ohmic heating to heat a thermionic cathode. In this way, electrons can be produced in a quantity sufficient to form an electron current necessary for generating x-ray radiation at the target, while significantly reducing the requisite power requirements for the radiation source.

SUMMARY OF THE INVENTION

The present invention features an efficient, portable, and rugged x-ray source, which is adapted for use in materials analysis systems, and which includes a laser-heated thermionic cathode. The x-ray source includes an optical source, an optical delivery structure, and an x-ray generator assembly. In a preferred embodiment, the optical delivery structure is a lens, and the optical source is a laser.

The x-ray generator assembly includes an electron source, an anode, and a target element. The electron source is responsive to optical radiation, generated by the optical source and transmitted through the optical delivery structure, to generate an electron beam along a beam path. The electron source is preferably a thermionic cathode having an electron emissive surface. The anode is positively biased relative to the thermionic cathode, and attracts the electrons emitted from the cathode. The target element is positioned in the electron beam path. The target element includes x-ray emissive material adapted to emit x-rays in response to incident accelerated electrons from the electron source. The anode intercepts and substantially eliminates leakage currents and field emitted currents. The accuracy of the target beam current measurement is thereby substantially increased.

The x-ray source includes means for providing an accelerating voltage between the electron source and the target element so as to establish an accelerating electric field which acts to accelerate electrons emitted from the electron source toward the target element. The means for providing an accelerating voltage may be a high voltage power supply.

The optical delivery structure is preferably an aspherical lens, adapted to focus incoming optical radiation onto a spot on the surface of the thermionic cathode. The lens directs a beam of optical radiation, generated by the laser and transmitted through the lens, to impinge upon a surface of the thermionic cathode. The beam of transmitted optical radiation has a power level sufficient to heat at least a portion of the surface to an electron emitting temperature so as to cause thermionic emission of electrons from said surface.

In a preferred embodiment, the target element has an inclined surface defining an angle of inclination with respect to the beam path. The angle of inclination may be from about 40 degrees to about 50 degrees, and preferably is about 40 degrees. The target is preferably a grazing incidence target, i.e. a target from which x-rays are emitted substantially at or near the angle of the inclined plane. The grazing incidence target provides maximum target efficiency, at both high and low energies, and also provides maximum tunability of the x-ray source voltage.

In a preferred embodiment, a dielectric element is disposed between the optical source and the cathode in order to provide high voltage insulation between the power supply and the electron source.

Using a laser-heated thermionic cathode, rather than a resistively heated cathode, greatly reduces the power requirements for the x-ray source. In addition, the very small size and mass of the heated portion permits very rapid turning on and off of the system. This greatly reduces the average power consumption of the x-ray source. In one embodiment, the power required to heat the electron emissive surface of the cathode, so as to generate an electron beam forming a current of about 100 micro amps, was between about 0.1 Watts to about 3.0 Watts. Because of the greatly reduced power requirements, the x-ray source of the present invention can be fabricated in a miniaturized model, operating on portable battery power.

DETAILED DESCRIPTION

The present invention provides an optically driven, increased efficiency, miniaturized x-ray source for use in materials analysis systems. The x-ray source includes a laser-heated thermionic cathode, in contrast to prior art x-ray sources for materials analysis, which have resistively heated thermionic cathodes, or field emitter cathodes. Heating the thermionic cathode with a laser, rather than with a current, significantly reduces the power requirements for the x-ray source. The x-ray source includes an inclined-plane, grazing incidence target, by which the efficiency of x-ray generation may be improved.

Figure 1:
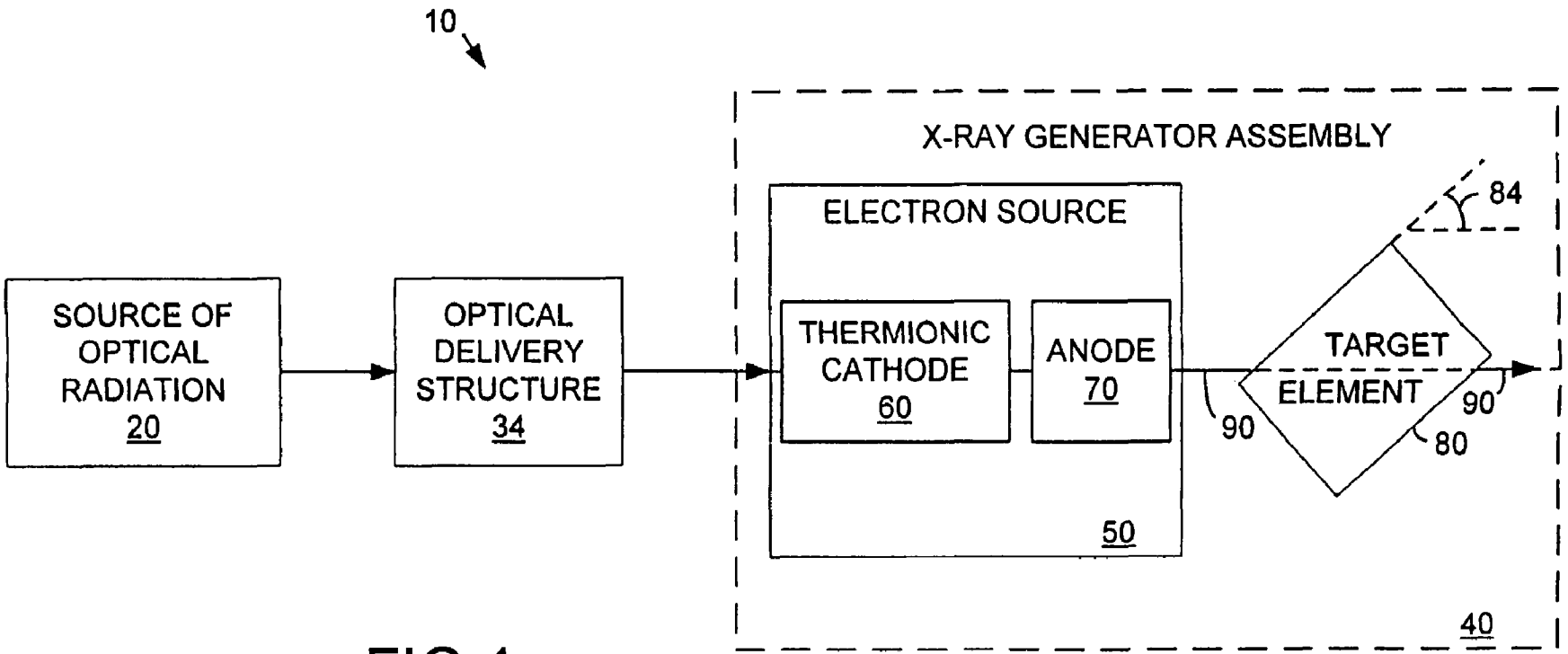
FIG. 1 is a schematic block diagram of an overview of an x-ray source constructed according to the present invention.

FIG. 1 is a schematic block diagram of an overview of an x-ray source 10 for materials analysis, constructed according to the present invention. In overview, the x-ray source 10 includes an optical source 20, an optical delivery structure 30, and an x-ray generator assembly 40. The x-ray generator assembly 40 includes an electron source 50, an anode 70, and a target element 80. The electron source 50 is responsive to optical radiation, generated by the optical source 20 and transmitted through the optical delivery structure 30, to generate an electron beam along a beam path 90. The electron source 50 is preferably a thermionic cathode 60. The optical delivery structure 34 is preferably a lens, but other types of optical delivery structures, such as a fiber optic cable, are also within the scope of the present invention.

The optical delivery structure 34 directs a beam of optical radiation generated by the optical source 20 and transmitted through the delivery structure 34 onto the thermionic cathode 60. The incident beam of optical radiation heats the thermionic cathode 60 so as to cause thermionic emission of electrons. The target element 80 is positioned in the beam path 90. The target element 80 includes an x-ray emissive material adapted to emit x-rays in response to incident accelerated electrons from the electron source 50. In a preferred embodiment, the target element 80 has an inclined surface 82, which defines an angle of inclination 84 with respect to the beam path 90.

Figure 2:
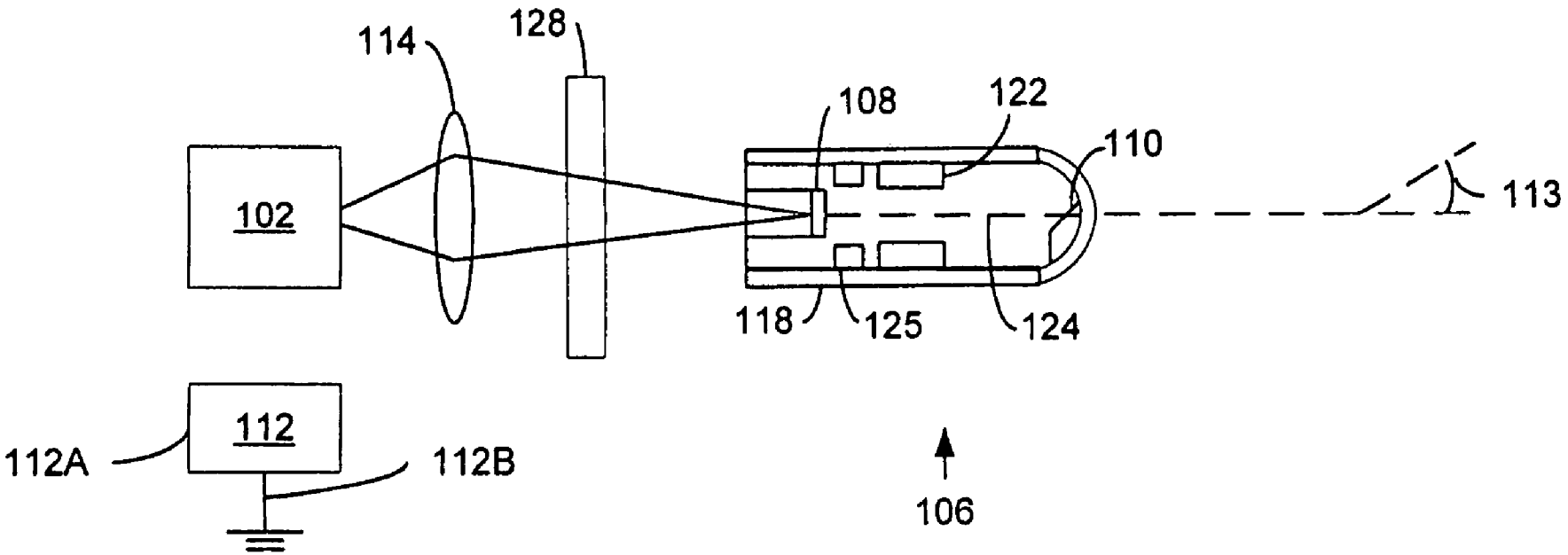
FIG. 2 illustrates a diagrammatic view of one embodiment of an x-ray source constructed in accord with the present invention and adapted for materials analysis systems.

FIG. 2 illustrates a more detailed, diagrammatic view of one embodiment of an x-ray source 100 constructed in accord with the present invention, and adapted for materials analysis systems. The x-ray source 100 includes an optical source 102, an optical delivery structure 114, and an x-ray generator assembly 106. The x-ray generator assembly includes an electron source 108, an anode 122, and a target element 110. The x-ray source 100 also includes means 112 for providing an accelerating voltage so as to establish an accelerating electric field that acts to accelerate the electrons emitted from the electron source 108 toward the target element 110. The means 112 for providing an accelerating voltage may be a high voltage power supply.

In a preferred embodiment, the optical source 102 is a laser, so that the optical radiation generated by the source is substantially monochromatic, and coherent. The laser 102 may be a diode laser, by way of example; however other lasers known in the art may be used, including but not limited to, Nd:YAG laser or a Nd:$YVO_4$ and molecular lasers. Alternatively, other sources of high intensity light may be used, such as LEDs (light emitting diodes) and laser diodes.

In the illustrated embodiment, the optical delivery structure 114 is a lens for focusing incoming optical radiation, generated by the laser 102. Preferably, the lens 114 is an aspherical lens adapted to focus light from the laser 102 onto a spot on the electron source. The aspherical lens 114 is adapted to change the focal point of the incoming laser beam, so as to obtain the desired beam strength.

The x-ray generator assembly 106 may be about 0.5 to about 5 cm in length, by way of example. The x-ray generator assembly preferably includes a shell or capsule 118 which encloses the electron source 108, the anode 122, and the target element 110. According to one embodiment, the capsule 118 is rigid in nature and generally cylindrical in shape. The cylindrical capsule 118, which encloses the constituent elements of the x-ray generator assembly 106, can be considered to provide a substantially rigid housing for the electron source 108, the anode 122, and the target element 110. In this embodiment, the electron source 108 and the target element 110 are disposed within the capsule 118, with the electron source 108 disposed at a proximal end of the capsule 118, and the target element disposed at a distal end of the capsule 118.

The capsule 118 defines a substantially evacuated interior region extending along the beam axis, between the electron source 108 at the proximal end of the capsule 118 and the target element 110 at the distal end of the capsule 118. The capsule 118 may be formed of materials including, but not limited to, glass and ceramic. The inner surface of the x-ray generator assembly 106 may be lined with an electrical insulator, while the external surface of the assembly 106 can be electrically conductive.

In the illustrated preferred embodiment of the invention, the electron source 108 is preferably a thermionic cathode 108 having an electron emissive surface. Upon heating of the thermionic cathode to a thermionic temperature, the cathode generates an electron beam along an electron beam path 124. The x-ray generator assembly 106 also includes an anode 122 for attracting the electrons emitted from the thermionic cathode 108. A focusing electrode 125 may also be included for concentrating the emitted electron beam onto a small spot. Typically, the focusing electrode is formed of a metallic material, and is annular in shape.

The target element 110 is preferably spaced apart from and opposite the electron emissive surface of the thermionic cathode 108, and has at least one x-ray emissive material adapted to emit x-rays in response to incident accelerated electrons from the electron emissive surface of the thermionic cathode 108. The target 110 is preferably at ground, or at a slightly negative potential. In a preferred embodiment, the target element 110 has an inclined surface that defines an angle of inclination 113 with respect to the electron beam path.

In a preferred embodiment of the invention, the x-ray source 100 further includes a dielectric element 128 disposed between the optical source 102 and the x-ray generator assembly 106. The dielectric element 128 is made of a dielectric material, such as glass. Because dielectrics such as glass have a high breakdown voltage, over 30 kV, the dielectric element easily provides high voltage insulation for the cathode.

The lens 114 is adapted to allow a beam of laser radiation to be transmitted therethrough and to impinge upon the electron-emissive surface of the thermionic cathode 108. The lens 114 is preferably an aspherical lens, which can focus the laser beam onto a single spot on the surface of the cathode 108. The beam of laser radiation must have a power level sufficient to heat at least a portion of the electron-emissive surface to an electron emitting temperature so as to cause thermionic emission of electrons from the surface.

In the illustrated embodiment, the high voltage power supply 112 provides an accelerating voltage so as to establish an accelerating electric field which acts to accelerate the electrons emitted from the thermionic cathode 108 toward the target element 110. The high voltage power supply 112 has a first terminal 112A and a second terminal 112B, and has drive means for establishing an output voltage between the first terminal 112A and the second terminal 112B. In one form, the power supply 112 may be electrically coupled to the target element 110 by way of the first and second terminals. The first terminal of the power supply may be electrically coupled to the electron emissive surface of the thermionic cathode, and the second terminal may be electrically coupled to the target element.

The accelerating voltage provided by the power supply accelerates the electrons emitted from the thermionic cathode 108 toward the target element 110, and an electron beam is generated. The electron beam is preferably thin (e.g. 1 mm or less in diameter), and is established along a beam path 124 along a nominally straight reference axis that extends to the target element 110. The target element 110 is positioned in the beam path 124. The distance from the electron source 108 to the target element 110 is preferably less than 2 mm. The acceleration potential difference is established between the cathode 108 and the anode 122, and the region between the anode 122 and the target element 110 is a substantially field-free drift region.

The high voltage power supply 112 preferably satisfies three criteria: 1) small in size; 2) high efficiency, so as to enable the use of battery power; and 3) independently variable x-ray tube voltage and current, so as to enable the unit to be programmed for specific applications. Preferably, the power supply 112 includes selectively operable control means, including means for selectively controlling the amplitude of the output voltage and the amplitude of the beam generator current. A high-frequency, switch-mode power converter is preferably used to meet these requirements. The most appropriate topology for generating low power and high voltage is a resonant voltage converter working in conjunction with a high voltage, Cockroft-Walton-type multiplier. Low-power dissipation, switch-mode power-supply controller-integrated circuits (IC) are currently available for controlling such topologies with few ancillary components. A more detailed description of an exemplary power supply suitable for use as the power supply is provided in U.S. Pat. Nos. 5,153,900 and 5,428,658.

Figure 3:
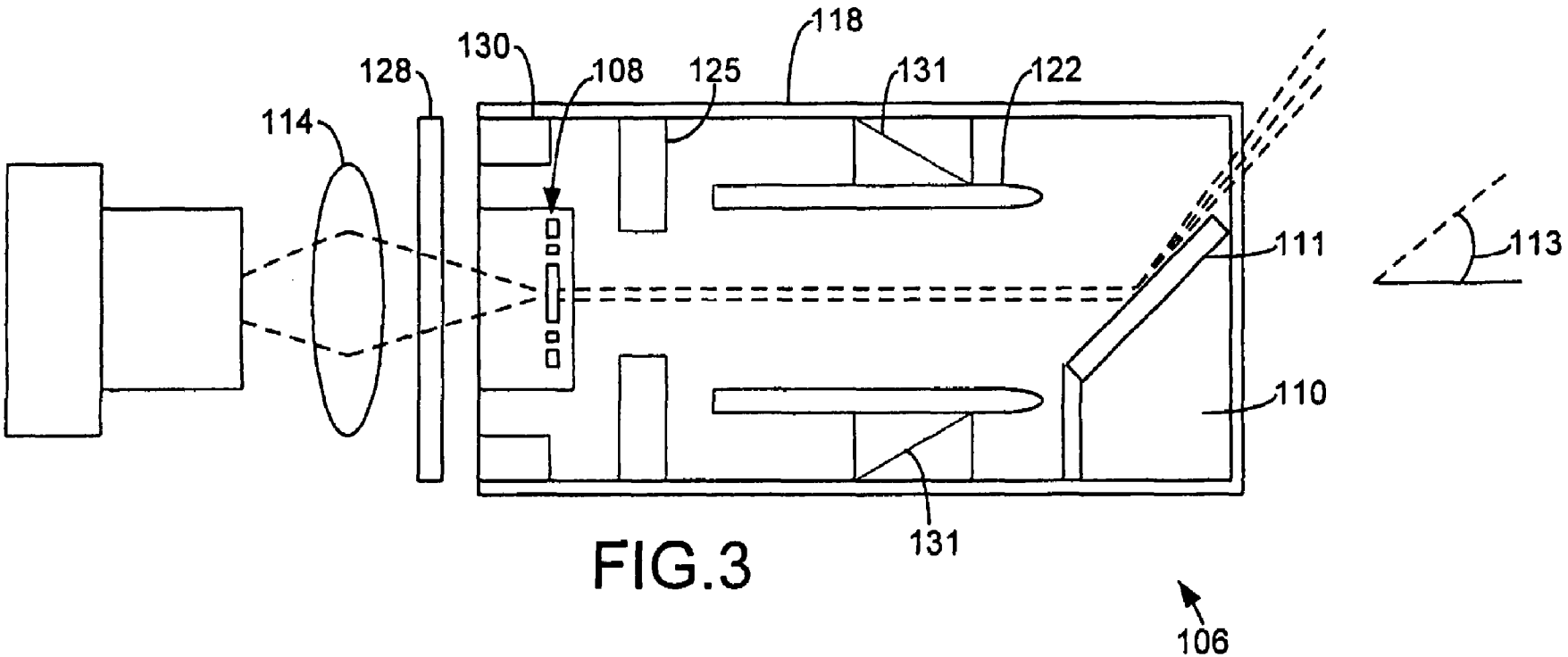
FIG. 3 provides an enlarged view of a lens and an x-ray generator assembly, constructed in accordance with the present invention.

FIG. 3 provides an enlarged view (not to scale) of the lens 114, and the capsule 118 that contains the constituent elements of the x-ray generator assembly 106, namely the thermionic cathode 108, the anode 122, and the target element 110.

The thermionic cathode 108 preferably has an electron emissive surface, and is typically formed of a metallic material. Suitable metallic materials forming the cathode 108 may include tungsten, thoriated tungsten, other tungsten alloys, rhenium, thoriated rhenium, and tantalum. In one embodiment, the cathode 108 may be formed by depositing a layer of electron emissive material on a base material, so that an electron emissive surface is formed thereon. By way of example, the base material may be formed from one or more metallic materials, including but not limited to Group VI metals such as tungsten, and Group II metals such as barium. In one form, the layer of electron emissive material may be formed from materials including, but not limited to, aluminum tungstate and scandium tungstate. The thermionic cathode 108 may also be an oxide coated cathode, where a coating of the mixed oxides of barium and strontium, by way of example, may be applied to a metallic base, such as nickel or a nickel alloy. The metallic base may be made of other materials, including Group VI metals such as tungsten. The cathode 108 may be held in place by means of swage of the end or by laser welding.

In a preferred embodiment, the thermionic cathode has a spiral-shape configuration, designed to minimize heat loss through thermal conduction. Spiral-shaped cathode configurations are disclosed in U.S. application Ser. No. 09/884,229, commonly owned by the assignee of the present invention, and hereby incorporated by reference.

Getters 130 may be positioned within the capsule. The getters 130 aid in creating and maintaining a vacuum condition of high quality. The getter 130 has an activation temperature, after which it will react with stray gas molecules in the vacuum. It is desirable that the getter have an activation temperature that is not so high that the x-ray source will be damaged when heated to the activation temperature.

The present invention provides for an anode 122, separate and apart from the target element 110. The anode 122 is positively biased, relative to the cathode 108, and may be positioned approximately 0.5 cm or more from the cathode 108. In the illustrated embodiment, the anode 122 has an annular shape, although other geometries are also within the scope of the present invention. The annular anode 122 includes a central aperture through which the electron beam passes. The anode 122 is preferably grounded.

Including in the x-ray generator assembly an anode 122 separate from the target element 110 provides several advantages. Any leakage current from the cathode to the anode can be intercepted by the anode 122, and bled off to ground. Leakage current through the capsule 118 not only generates undesirable heat, but also undermines the accuracy of the target beam current measurement, since current that is leaking through the capsule is not being used to generate x-rays. Any field emitted current is also intercepted by the anode 122. By providing a separate anode 122, the accuracy of the target beam current measurement is substantially increased in the present invention.

The x-ray generator assembly preferably includes a glass sealing structure 131, which is adapted to mechanically affix the anode 122 to the outer housing 118. The sealing structure 131 is made of a material having a lower melting point, but the same temperature coefficient, as the glass forming the outer shell 118. In one embodiment, this material includes an alloy consisting of 52% nickel, and 48% iron.

In one embodiment, the target element 110 may be a metallic substrate, either coated on the side exposed to the incident electron beam with a thin film or layer of a high-Z, x-ray emissive element, such as tungsten (W), uranium (U) or gold (Au), or consisting entirely of a solid target material, for example silver or tungsten.

In another embodiment, the target may be a thin film, formed of an x-ray emissive material, supported by an x-ray transmissive structure. By way of example, the target may include a thin film of gold or silver supported by an x-ray transmissive structure formed of beryllium (Be). In this embodiment, the beryllium substrate may be about 0.5 mm thick. When the electrons are accelerated to 30 keV–, a 2 micron thick gold layer absorbs substantially all of the incident electrons, while transmitting approximately 95% of any 30 keV–, 88% of any 20 keV–, and 83% of any 10 kev–x-rays generated in that layer. With this configuration, 95% of the x-rays generated in directions normal to and toward the beryllium substrate, and having passed through the gold layer, are then transmitted through the beryllium substrate and outward.

In a preferred embodiment of the invention, the target element 110 is an inclined-plane target, i.e. includes an inclined surface 111, which defines an angle of inclination 113 with respect to the incident electron beam. The inclined surface of the target may be coated with a layer of metal, such as silver or rhodium, whose characteristic spectral lines are sufficiently spaced apart from the spectral lines of the materials being detected so as not to cause any interference with the spectrum of the materials being analyzed. The preferred angle of inclination 113 is about 40 degrees.

Preferably, the target is a grazing incidence target, i.e. the x-rays are emitted from the inclined-plane target 110 substantially at or near the angle of inclination 113, as shown in FIG. 3A. For an inclined-plane target having a plane of inclination of about 40 degrees, the emitted x-rays form a beam of about 45 degrees, i.e. the x-rays will be focused and centered around the 45 degree axis. A grazing incidence target maximizes the efficiency of x-ray generation, and the tunability of the voltage provided to the x-ray source. In other words, the x-ray source voltage may be tuned as desired, within a range of about 10 keV to about 35 keV, and x-rays can be efficiently generated at all energies, both high and low, and for both relatively thin and relatively thick target thicknesses.

Conventional prior art thin film targets, which do not have an inclined plane and a grazing incidence feature, are less efficient, and provide for less tunability in the electron kinetic energy. For example, with a conventional planar thin film target having a relatively small thickness, there is a risk that if the voltage is increased, a substantial portion of the electrons in the incident electron beam pass through the target without interacting with the constituent atoms of the target material to generate x-rays. On the other hand, for a conventional thin film planar target having a relatively large thickness, there is a risk that if the voltage is decreased, a substantial portion of the electrons would generate x-rays within the target, the x-rays being subsequently absorbed by the remaining target material. In either case, the efficiency of x-ray generation would be substantially undermined. An inclined-plane, grazing incidence target, as provided for in the present invention, substantially improves the efficiency of x-ray generation in the target, as well as the tunability of the accelerating voltages provided to the x-ray source.

In operation, the laser beam shining down the fiber optic cable 114 impinges upon the surface of the thermionic cathode 108, and rapidly heats the surface to an electron emitting temperature, below the melting point of the metallic cathode 108. Upon reaching of the surface of a electron emitting temperature, electrons are thermionically emitted from the surface. The high voltage field between the cathode 108 and the target element 110 accelerates these electrons, thereby forcing them to strike the surface of the target element 110 and produce x-rays.

X-rays are produced when the incident electrons, interacting with the target nuclei, are decelerated and eventually brought to rest. The x-ray spectrum consists of a continuous bremsstrahlung spectrum, and x-ray spectral lines characteristic of the target material. Bremsstrahlung radiation occurs because of the decelerating Coulomb interaction between the electron and the target nucleus. The discrete spectral lines are characteristic of the transitions between bound electron energy levels of the atoms forming the target element, as allowed by the selection rules.

The x-ray source of the present invention is used for materials analysis system. In one embodiment of the invention, an intense beam of the emitted x-rays irradiates a material being analyzed, exciting the constituent atoms of the material. This causes transitions between the inner-shell electrons (for example, the K-shell electrons), which causes the emission of x-ray photons. X-ray line spectra characteristic of the constituent atoms of the material are thus emitted. The resulting x-ray spectra can be analyzed, in order to identify the constituent components of the material being analyzed.

In one embodiment of the invention, only a few watts of power was needed to generate over 100 μA of electron current. In particular, the power required to heat the electron emissive surface of the cathode so as to generate an electron beam forming a current of about 100 micro amps was between about 0.1 Watts to about 3.0 Watts. By using a laser to heat the thermionic cathode, the power requirements for the x-ray probe of the present invention are thus significantly reduced. Because of the significantly increased efficiency, the x-ray source of the present invention can be built in a reduced size model that can be operated using power from a portable battery. By providing a dielectric element between the optical source and the x-ray generator assembly, high voltage isolation between the cathode and the power source is easily achieved. By providing an anode 122 separate and apart from the target, and a field-free drift region for the electrons, leakage currents and field emitted currents are eliminated.

The present invention improves the stability, as well as the efficiency, of x-ray generation. The stability of the x-ray output is improved by providing a constant accelerating voltage, a constant beam current, and a uniform target. The constant accelerating voltage may be implemented a high voltage feedback loop. The constant beam current may be implemented by sensing the target current, and feeding back the current to the laser that serves to heat the cathode.

The present invention provides for an efficient, low-energy, easily manipulated, portable, and controllable x-ray source for materials analysis. The x-ray source 100 of the present invention may be operated at low energy and power in a wide range of applications. The x-ray source may be used to identify the constituent components of a composite material. For example, the x-ray source may be used to identify contaminants in soil, or to identify differences between alloys. The x-ray source may be used as a screening tool for detecting lead in paint. The x-ray source may also be used in flow-through systems for process control in materials fabrication.

While the invention has been particularly shown and described with reference to specific preferred embodiments, it should be understood by those skilled in the art that various changes in form and detail may be made therein without departing from the spirit and scope of the invention as defined by the appended claims.

The invention claimed is:

1. A substantially rigid capsule formed of a dielectric material and containing an electron source, an anode, and a sealing structure, said capsule defining a substantially evacuated interior region extending along a beam axis between said electron source and said anode;

wherein said sealing structure is adapted to affix said anode to said capsule;

wherein said sealing structure is formed of a material having a relatively low melting point relative to said dielectric material forming said capsule, and having substantially the same temperature coefficient as said dielectric material, and wherein said electron source includes a thermionic cathode and said capsule includes a target along said beam axis, and wherein said anode is adapted to attract electrons emitted from said cathode, and wherein said anode is positioned between said cathode and said target.

2. A capsule according to claim 1, wherein said material forming said sealing structure is an alloy comprising about 52% nickel and about 48% iron.

3. The capsule of claim 1, wherein the thermionic cathode is responsive to incident optical radiation, from an optical source and delivered to the thermionic cathode through an optical delivery structure, for generating an electron beam along the beam path, said thermionic cathode having an electron emissive surface;

wherein said target element includes at least one x-ray emissive material adapted to emit x-rays in response to incident accelerated electrons from said electron source; and further comprising means for providing an accelerating voltage between said electron source and said target element so as to establish an accelerating electric field which acts to accelerate electrons emitted from said electron source toward said target element.

4. The method of claim 3 wherein said target element has an inclined surface defining an angle of inclination with respect to said beam path.

5. A capsule according to claim 4, wherein said angle of inclination being about 40 degrees to about 50 degrees with respect to said beam axis.

6. A capsule according to claim 5, wherein said inclined surface of said target is coated with a layer of metal.

7. A capsule according to claim 6, wherein said metal is at least one of silver or rhodium.

8. A capsule according to claim 5, wherein said x-rays are emitted substantially at or near said angle of inclination with respect to said electron beam path.

9. A capsule according to claim 4, further including a dielectric element disposed between said optical source and said cathode for providing high voltage insulation between said means for providing an accelerating voltage and said cathode.

10. A capsule according to claim 9, wherein said dielectric element is made of glass.

11. A capsule according to claim 4, wherein said optical source is a laser, configured to provide a beam of optical radiation which is substantially monochromatic and coherent.

12. A capsule according to claim 4, wherein said electron emissive surface of said thermionic cathode is formed of a metallic material.

13. A capsule according to claim 4, wherein said electron beam is characterized by a current in the approximate range of about 1 nA to about 1 mA.

14. A capsule according to claim 4, wherein said electrons incident on said target element from said electron emissive surface are accelerated by said accelerating electric field to energies in the approximate range of 10 keV to 90 keV.

15. A capsule according to claim 4, wherein the means for providing an accelerating voltage is a high voltage power supply, said power supply having a first terminal and a second terminal, said power supply being electrically coupled to said capsule by way of said first terminal and said second terminal.

16. A capsule according to claim 15, wherein said power supply further includes selectively operable control means for selectively controlling the amplitude of said output voltage.

17. A capsule according to claim 15, further including selectively operable control means for selectively controlling the amplitude of the current of said beam.

18. A capsule according to claim 4, wherein said optical delivery structure comprises a lens.

19. A capsule according to claim 18, wherein said lens comprises an aspherical lens.

20. A capsule according to claim 4, wherein the means for establishing an accelerating voltage is a high voltage power supply, said power supply having a first terminal and a second terminal, said power supply being electrically coupled to said x-ray generator assembly by way of said first terminal and said second terminal.

21. A capsule source according to claim 1, wherein said anode includes an aperture for allowing passage of said electrons therethrough.

22. A capsule according to claim 1, wherein said cathode is a metallic material from the group consisting of tungsten, thoriated tungsten, a tungsten alloy, rhenium, thoriated rhenium, and tantalum.

23. A capsule according to claim 1, wherein said thermionic cathode includes a metallic base coated with an oxide.

24. A capsule according to claim 23, wherein said oxide includes barium oxide, strontium oxide, and calcium oxide and said metallic base includes nickel.

25. A capsule according to claim 1, wherein said electron source and said target element are disposed within said substantially rigid capsule and further wherein said capsule defines a substantially evacuated interior region extending along a beam axis between said thermionic cathode at a proximal end of said capsule and said target element at a distal end of said capsule.

26. A capsule according to claim 1, wherein power required to heat said electron emissive surface of said cathode so as to generate an electron beam forming a current of about 100 micro amps is between about 0.1 Watts to about 3.0 Watts.

* * * * *